United States Patent [19]

Bahnfleth

[11] 4,343,119

[45] Aug. 10, 1982

[54] BEVELED LOBE ANTI-SKID GRATING

[75] Inventor: William A. Bahnfleth, East Peoria, Ill.

[73] Assignee: Caterpillar Tractor Co., Peoria, Ill.

[21] Appl. No.: 218,496

[22] Filed: Dec. 22, 1980

Related U.S. Application Data

[63] Continuation of Ser. No. 89,120, Jun. 18, 1979, abandoned.

[51] Int. Cl.[3] ..... B32B 3/10; E04C 2/42; F16S 1/08

[52] U.S. Cl. ..... 52/180; 52/673; 15/238; 428/597; 428/132; 428/134; 29/163.5 R; 413/15

[58] Field of Search ..... 52/177, 180, 673; 238/14; 280/169, 164 A; 29/160, 163.5 R; 113/116 A; 428/597, 132, 134; 404/21; D23/135, 137, 112; D25/69; 15/238

[56] References Cited

U.S. PATENT DOCUMENTS

| | | | |
|---|---|---|---|
| D. 81,988 | 9/1930 | MacDonald | D25/69 |
| 117,924 | 8/1871 | Peirce | 428/597 X |
| 538,467 | 4/1895 | Schaper | 52/675 |
| 1,044,283 | 11/1912 | Stanger | 72/325 |
| 1,076,017 | 10/1913 | Chase | 29/160 |
| 1,166,423 | 1/1916 | Atwood | D25/69 X |
| 1,215,235 | 2/1917 | Atwood | D25/69 X |
| 1,268,802 | 6/1918 | Schumacher | 52/675 |
| 1,441,327 | 9/1923 | Blum | 52/177 |
| 1,959,101 | 5/1934 | Hasselquist | 113/116 A |
| 2,004,747 | 6/1935 | Daly | 428/597 X |
| 2,281,822 | 5/1942 | Bills et al. | 52/180 |
| 2,590,807 | 3/1952 | Voslamber | 164/109 |
| 2,828,843 | 4/1958 | Hill | D25/69 X |
| 3,093,216 | 6/1963 | Dunham | 52/180 |

FOREIGN PATENT DOCUMENTS

| | | |
|---|---|---|
| 2205080 | 5/1974 | France . |
| 220106 | 8/1924 | United Kingdom . |

*Primary Examiner*—George F. Lesmes
*Assistant Examiner*—Alexander S. Thomas
*Attorney, Agent, or Firm*—Wegner, Stellman, McCord, Wood & Dalton

[57] ABSTRACT

An improved anti-skid tread or grating (10) design is provided with gripping members or rosettes (30) having a plurality of upstanding individual lobes (36) which are configured in such a way and project high enough to provide an excellent gripping surface. The lobes (36) of the design are self-cleaning, and have non-continuous gripping edges at their crests (40) that accommodate a greater build up of ice or mud without clogging the grating (10).

2 Claims, 6 Drawing Figures

BEVELED LOBE ANTI-SKID GRATING

This is a continuation, of application Ser. No. 89,120 filed June 18, 1979 now abandoned.

TECHNICAL FIELD

This invention related to an anti-skid tread and, more particularly, to an anti-skid tread having non-continuous, self-cleaning lobes.

BACKGROUND ART

There are a large number of places where steel tread plate is used and, in fact, where it is required, such as on steps, decks and walkways on earthmoving equipment or railroad engines, on bridges, on cranes, and the like. Its use is dictated by its strength and by its ability to have its surface corrugated, roughed or distressed so as to provide an anti-skid, gripping surface. In the past, the desired anti-skid, gripping surface characteristics have been accomplished, particularly under reasonably ideal conditions. However, under footwear containing heavy mud, or under mud, water and freezing conditions, the corrugated, roughened or distressed surfaces may become clogged or packed with mud and/or ice and become dangerous.

Many of the prior art devices have openings which do provide a cleaning function, but they are shaped in a way that the mud and the like compact in the openings, clogging the openings and rendering the tread less than 100% effective.

Some prior art devices have a continuous edge for the contact surface of the tread which edge can become iced and slippery.

DISCLOSURE OF THE INVENTION

The present invention is directed to overcoming one or more of the problems as set forth above.

The present invention has all of the advantages of the prior art devices including an anti-skid tread. In addition, the invention has non-continuous gripping edges that are provided by lobes that stick up high enough to provide the grip desired and wherein the lobes are configured and spaced in a manner to provide self-cleaning characteristics without compacting and accumulating debris. The crests of the lobes have rounded abrading edges for gripping the sole of the footwear or the bottom of a container, or the like, to reduce or eliminate slipping across the surface of the tread.

A novel punch and backup ring are provided for punching gripping members or rosettes into a metal sheet to produce the tread or grating.

The improved grating or tread is easier and cheaper to manufacture while still maintaining all of the desired features and advantages.

BEST MODE FOR CARRYING OUT THE INVENTION

Figure 1:
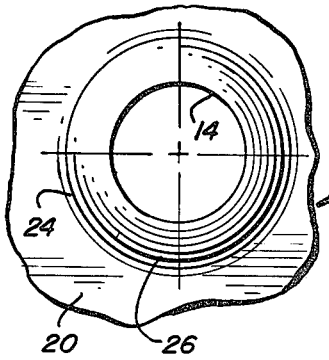
FIG. 1 PRIOR ART
FIG. 1 is a top plan view of a gripping member of one prior art device.
Figure 2:
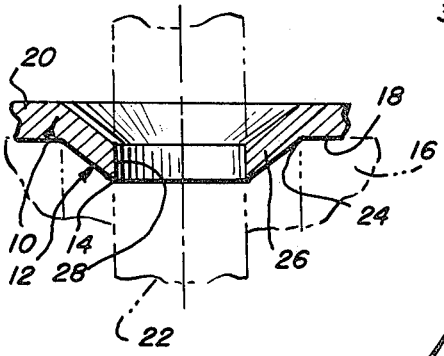
FIG. 2 PRIOR ART
FIG. 2 is a cross-sectional view taken along line 2—2 of FIG. 1 with a punch and die shown in phantom.

Referring to the drawings wherein similar reference numerals refer to similar parts throughout, FIGS. 1 and 2 show one popular prior art grating 10 with a gripping member 12 having a continuous gripping and cleaning edge 14 struck upward from the plane of the grating 10. Each gripping member 12 may be made by positioning a backup die 16, shown in phantom in FIG. 2, against the under surface 18 of the plate 20 whereupon a circular punch 22, shown in phantom in FIG. 2, strikes the plate 20 from above and distorts the plate 20 at the edge 24 of the die 16 to form a conical surface 26 extending angularly away from the plate 20. The punch 22 penetrates the plate 20 leaving the continuous edge 14 about a circular aperture 28 in the plate. After a plurality of gripping members 12 are struck from the plane of the plate 20, the plate is turned over so that the edges 14 project upward for gripping the bottoms of footwear walking on the grating. The apertures 28 will provide clean-out openings into which dirt, mud, ice, and the like, can be scraped. It has been found that the conical surfaces 26 are not long enough and the continuous circular edges 14 can become ice coated and less effective than desired. The mud and ice compacts in the apertures 28 and, if it dries or freezes there, reduces the gripping and cleaning ability of the grating.

Figure 3:
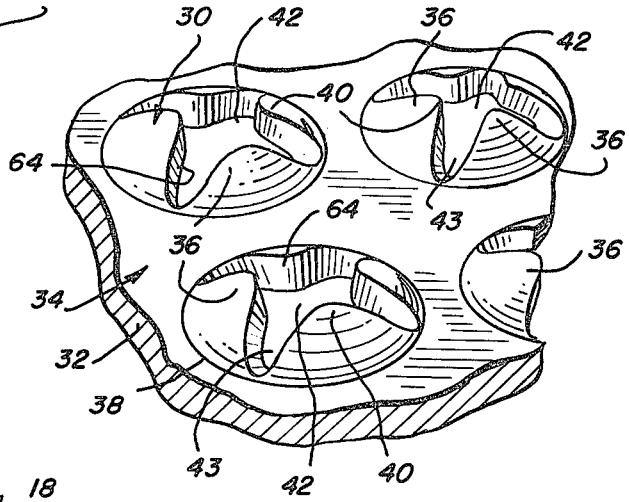
FIG. 3 is a perspective view of a portion of a piece of tread or grating showing the improved rosettes or gripping members of the present invention.
Figure 4:
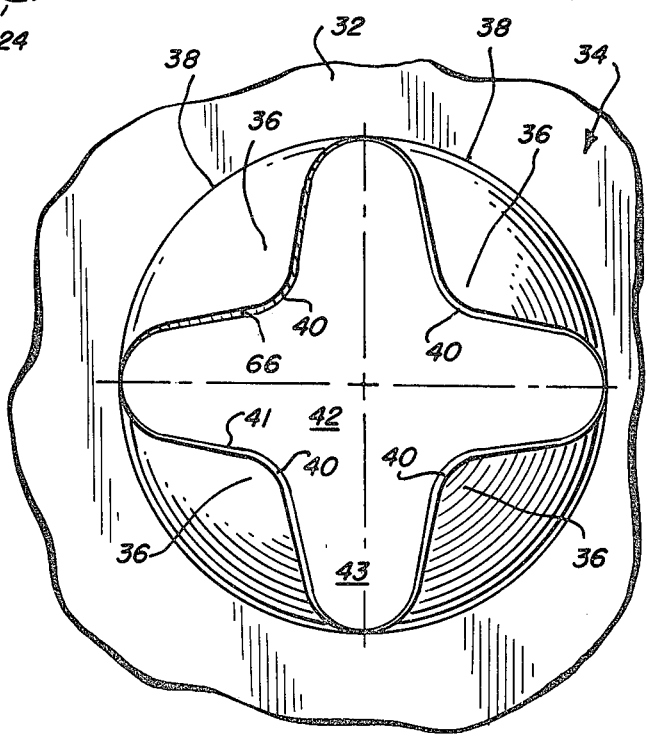
FIG. 4 is an enlarged plan view of a rosette or gripping member of the improved design.

As shown in FIGS. 3 and 4, an improved gripping member or rosette 30 is shown struck from a plate 32 to form a grating or tread 34. A plurality of gripping members or rosettes 30 project upward from the plate 32, either in an established pattern or in a random pattern. The pattern of rosettes 30 in the plate 32 forms no part of the invention.

Each gripping member or rosette 30 includes, preferably, three or four lobes 36 extending upwardly from the plane of the plate 32. Each lobe 36 is tongue-shaped or has a somewhat parabolic configuration with the lobe 36 connected to the plate 32 along a circular path at a base 38. Each lobe 36 ascends upward and inward to form a crest 40 which is spaced from each crest 40 of the remaining lobes 36 to provide a star-shaped opening or aperture 42 between the lobes 36. Aperture 42 is defined by a continuous wall 41 extending around the edges of the lobes 36 and between adjacent lobes 36.

Aperture 42 includes extensions 43 between adjacent lobes 36 which extend from the crest 40 of one lobe to the base 38 thereof and to the crest 40 of an adjacent lobe 36. Portions of wall 41 defining extensions 43 between adjacent lobes 36 are preferably divergent as they extend from base 38 to their respective crests 40, as is best shown in FIG. 4.

Figure 5:
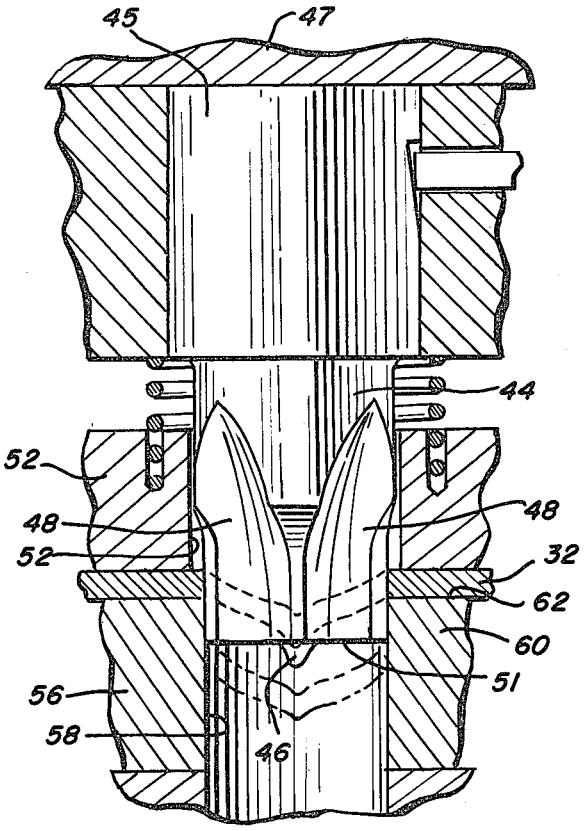
FIG. 5 is an enlarged view of a punch and backup ring with the punch penetrating a sheet of metal to form an improved rosette; and, FIG. 6 is an end view of the punch of FIG. 5.
Figure 6:
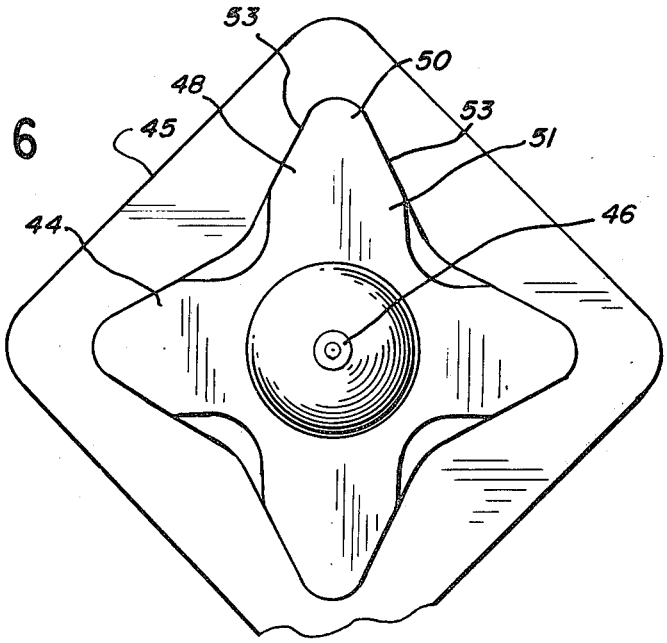

To produce the gripping members or rosettes 30, reference is made to FIGS. 5 and 6, wherein a punch 44 is provided which has a base 45 adapted to be connected to a moving head of ram 47 of a punch press, or the like, not shown. The punch 44 has a pointed leader 46 and a star-shaped cutting shank 48. The cutting shank 48 may have three or four radially extending flutes 50, each flute having a shape in horizontal cross section conforming to the extensions 43 of the aperture 42 in the resulting rosette 30. Each flute 50 has a flat end 51, the edges 53 of which form the cutting edge for the punch.

The punch press, not shown, has a guide 52 in which is formed an aperture 54 for receiving and guiding the punch 44 therein. A die 56, having circular cutouts or apertures 58, is positioned in the punch press with the axis of each cutout 58 aligned with the axis of an aligned aperture 54 in the guide 52. The die 56 with the cutout or aperture 58 aligned with the punch 44 in the guide 52 forms a backup ring 60 for the punch 44. In practice, the sheet or plate of steel 32 is placed on the top surface 62 of the die 56 whereupon the guide 52 is lowered against the top of the plate 32. The punch press is actuated to drive the punch 44 through the plate 32 to form the gripping members or rosettes 30 as the material of the plate 32 is deformed and pierced by the punch 44.

The inside diameter of the cutout 58 in the backup ring 60 is slightly larger than the outside diameter of the punch 44 such that the edges 53 of the flat end 51 of the flutes 50 starts cutting the plate 32 on the outer periphery of the punch corresponding to the inner periphery of the die 56. This causes the metal of the plate to be split into individual extensions 43 of the lobes 36 as the flutes 50 of the punch 44 pushes more metal ahead of it, to stretch the metal of the plate as it moves through the plate. As the punch 44 completes the penetration of the plate 32 and continues to traverse the opening 42 in the plate 32, the walls of the punch 44 will work the walls 41 of the extensions 43 and lobes 36 to shape them along a vertical path or even to give the wall 41 a shape which is slightly inwardly tapered or beveled toward the underside of the plate 32 as shown in FIGS. 3 and 4. Typical of die punch cuts in a plate, a small welt or ledge 66 is left around the top edge of the lobes 36 of the rosette 30 when the punch 44 is withdrawn, which welt or ledge 66 forms an additional cleaning edge for the rosette 30.

INDUSTRIAL APPLICABILITY

With a large number of rosettes or gripping members 30 struck from a plate 32 and the plate is inverted so that the rosettes 30 project upward from the plate, an improved, efficient and inexpensive tread or grating 10 is provided. The individual crests 40 of the lobes 36 bite into the soles of the footwear to grip and hold the footwear in place. The shape of the lobes 36 create extensions 43 in the opening therebetween which, along with the inwardly and downwardly beveled or sloped walls 41, clean mud, ice, and the like, from the soles of the footwear and because of said extensions 43, the residue of mud and ice does not compact in the opening 42. The mud and ice is spread out and dispersed so as to loosen it, thereby causing it to fall through the opening 42 in the grating under its own weight and from the force of the cleaning stroke of the footwear across the grating. The lobes 36 are taller, sharper and provide individual points of contact which improves the anti-skid and the self-cleaning characteristics of the grating 10. The edges of the lobes 36 are non-continuous in a plane thereby giving non-continuous gripping to footwear brought in contact therewith. Non-continuous gripping is considered somewhat preferred in recent United States Government safety specifications. The non-continuous gripping edges of the lobes 36 of the rosettes 30 are not likely to become iced over since pressure on the grating will cause the edges of the crests 40 of the lobes 36 to penetrate and crack the ice loose.

I claim:

1. In a grating (10) for use as a deck, said grating (10) including a substantially rigid metal plate (32), and a plurality of gripping members (30) extending upwardly from the plane of said plate (32), the improvement comprising:

a base (38) for each gripping member at the junction of each gripping member with said plate (32), at least three lobes (36) extending upwardly from said base, each lobe (36) having a parabolic tongue shaped configuration and being connected to the plate (32) along a circular path at said base, each lobe (36) ascending upward and inward to form a crest (40), each crest (40) of each lobe (36) being spaced from each crest (40) of the remaining lobes (36) to form a star-shaped opening (42) therebetween, and a continuous, vertically oriented wall (41) on the edge of each lobe (36) which wall (41) is spaced from a wall (41) of each adjacent lobe (36) to define said star-shaped opening and to define extensions (43) between adjacent lobes which extend from the crest (40) of one lobe to the base (38) thereof and to the crest (40) of an adjacent lobe (36), said extensions being parabolic shaped to provide substantial openings between the lobes at the base of each gripping member, portions of said walls (41) of said star-shaped opening (42) defining said extensions (43) between adjacent lobes (36) and diverging as they extend from said base (38) to their respective crests (40), said walls being tapered inwardly and downwardly toward the center of the opening to assist in dispersing mud scraped loose by said crests (40) of the gripping members (30).

2. In a grating (10) as claimed in claim 1 wherein each gripping means (30) is circular in shape and has four upwardly and inwardly projecting lobes (36).

* * * * *